US009706864B2

(12) United States Patent
Matus, Jr.

(10) Patent No.: US 9,706,864 B2
(45) Date of Patent: Jul. 18, 2017

(54) WINE GLASS STEM SPACER

(71) Applicant: Jose Orlando Matus, Jr., Gainesville, GA (US)

(72) Inventor: Jose Orlando Matus, Jr., Gainesville, GA (US)

( * ) Notice: Subject to any disclaimer, the term of this patent is extended or adjusted under 35 U.S.C. 154(b) by 606 days.

(21) Appl. No.: 14/189,767

(22) Filed: Feb. 25, 2014

(65) Prior Publication Data

US 2014/0314983 A1 Oct. 23, 2014

Related U.S. Application Data

(60) Provisional application No. 61/768,791, filed on Feb. 25, 2013.

(51) Int. Cl.
*A47G 23/02* (2006.01)

(52) U.S. Cl.
CPC ..... *A47G 23/0216* (2013.01); *Y10T 428/1376* (2015.01)

(58) Field of Classification Search
CPC ..... A47G 23/0225
USPC ..... 428/34.7, 35.1
See application file for complete search history.

(56) References Cited

U.S. PATENT DOCUMENTS 6,059,138 A * 5/2000 Labruyere ..... A47G 23/0225 220/23.4
2005/0263464 A1* 12/2005 Nunn ..... B60N 3/107 211/74
2008/0283716 A1* 11/2008 Roche ..... A47G 23/0225 248/523
2012/0193366 A1* 8/2012 Miller ..... F25D 3/08 220/592.17
2013/0200089 A1* 8/2013 Vidal ..... B23P 11/00 220/739

* cited by examiner

*Primary Examiner* — Ellen S Wood
(74) *Attorney, Agent, or Firm* — Smith Tempel Blaha LLC; Matthew T. Hoots

(57) ABSTRACT

Various embodiments, aspects and features of the present invention encompass a wine glass stem spacer configured to be coupled to, and decoupled from, a stemmed glass. An exemplary wine glass stem spacer is in the general form of a foam or soft rubber cylinder having a height that is substantially equivalent to the depth of a typical cup holder cavity. A stem receiving cavity may be bored through the spacer along a vertical axis and a vertical stem insertion slit may be cut from the outer surface of the spacer to the stem receiving cavity, thereby providing for coupling of the spacer around the stem of a wine glass. Advantageously, when an embodiment of the spacer is coupled to the stem of a certain wine glass, the wine glass may be protected from tilting when placed in a cup holder cavity.

5 Claims, 4 Drawing Sheets

4D

4C

4B

4A

WINE GLASS STEM SPACER

BACKGROUND

The present invention relates to stemmed glassware accessories and, more particularly, to a removable spacer or bushing device useful for preventing a wine glass from tilting when placed in a cup holder cavity.

When enjoying a beverage in a boat, for example, users often take advantage of cup holder cavities located in consoles and other locations. As is well known in the art, cans, bottles, cups and the like may be placed in a cup holder cavity when the user wants to set down his drink. Advantageously, because the basic shapes of most cans, bottles and many cups are sized to fit relatively snugly in a cup holder cavity, the risk of spilling the beverage held within is minimal when the can, bottle or cup is placed in a cup holder cavity.

Wine drinkers, however, cannot take advantage of cup holder cavities if they are enjoying their wine in a stemmed glass, i.e. a "wine glass," because the shape of the wine glass is prone to tilting in the cup holder cavity. Notably, as one of ordinary skill in the art would recognize, if a wine glass placed in a cup holder cavity is tilted, the wine in the bowl of the glass will likely slosh out, spill, splash or otherwise make a mess. Therefore, what is needed in the art is a wine glass stem spacer that can be coupled to a stemmed glass such that, when the stemmed glass is place in a cup holder cavity, the glass will not be prone to excessive tilting.

BRIEF SUMMARY

Various embodiments, aspects and features of the present invention encompass a wine glass stem spacer configured to be coupled to, and decoupled from, a stemmed glass. An exemplary wine glass stem spacer is in the general form of a foam or soft rubber cylinder having a height that is substantially equivalent to the depth of a typical cup holder cavity. Alternatively, the height of an exemplary wine glass stem spacer is envisioned to be any height that is more or less than the distance between the top of the foot and the bottom of the bowl of a certain wine glass. A stem receiving cavity may be bored through the spacer along a vertical axis and a vertical stem insertion slit may be cut from the outer surface of the spacer to the stem receiving cavity, thereby providing for coupling of the spacer around the stem of a wine glass. Advantageously, when an embodiment of the spacer is coupled to the stem of a certain wine glass, the wine glass may be protected from tilting when placed in a cup holder cavity.

Embodiments of a wine glass stem spacer according to the invention are not limited to the exemplary aspects and features described above. Certain embodiments may include additional features, or different features, while other embodiments include alternative features. As a way of example, and not limitation, it is envisioned that some embodiments of a wine glass stem spacer may include a hinge for opening and closing the stem receiving cavity, a concave aspect for interfacing to the bowl of a wine glass, etc. Moreover, while some embodiments of a wine glass stem spacer according to the invention may be constructed via soft rubbers or foams, embodiments are not limited by materials of construction as it is envisioned that a wine glass stem spacer may be constructed from any suitable material or combination of materials that may occur to one of ordinary skill.

BRIEF DESCRIPTION OF THE DRAWINGS

In the drawings, like reference numerals refer to like parts throughout the various views unless otherwise indicated. For reference numerals with letter character designations such as "135B" or "135F", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

Figure 1:
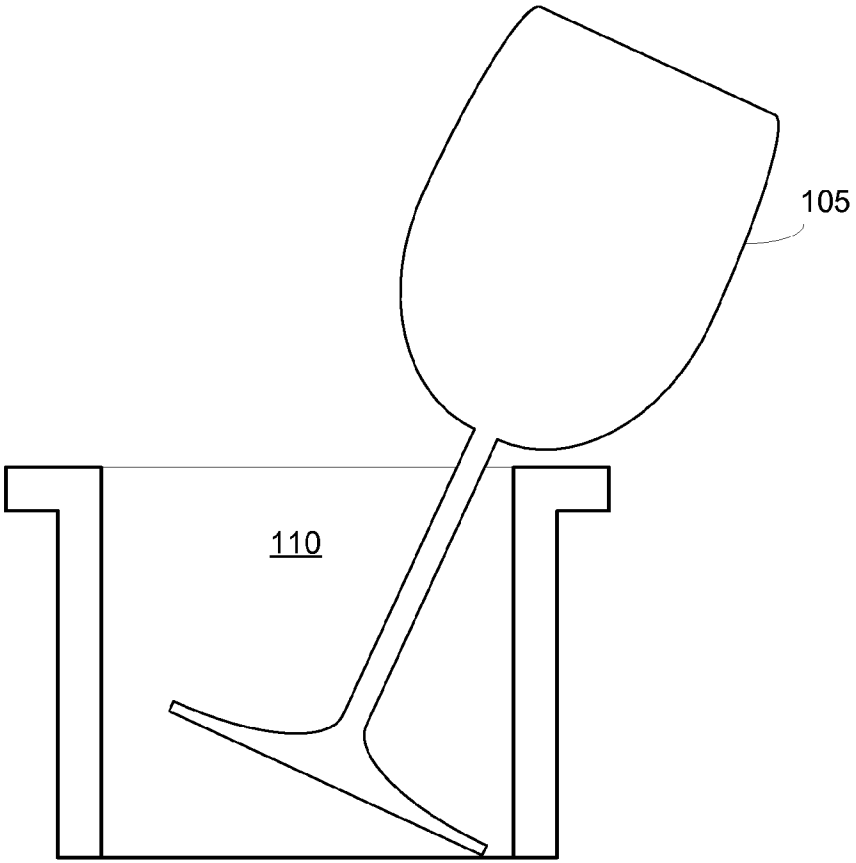
FIG. 1 illustrates a wine glass inserted into a cup holder.

FIG. 1 is an illustration of a problem that is solved by embodiments of a wine glass stem spacer. In the FIG. 1 illustration, a typical stemmed wine glass 105 is depicted positioned in a cup holder 110. As one of ordinary skill in the art would recognize, the wine glass 105 may be free to tilt in the cup holder cavity. As a result, a wine glass 105 placed in a cup holder 110 may not be secure enough to prevent the wine glass 105 from spilling contents.

Figure 2:
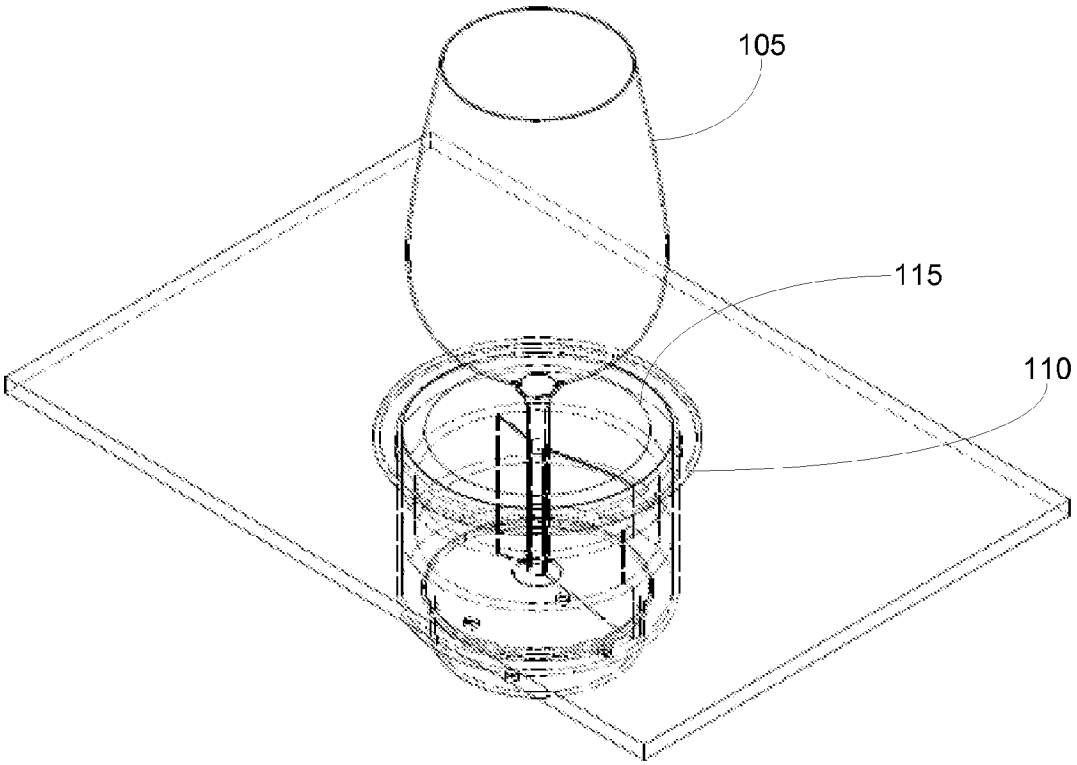
FIG. 2 illustrates a wine glass inserted into a cup holder, shown with an exemplary embodiment of a wine glass stem spacer for preventing tilting of the wine glass.

FIG. 2 illustrates a wine glass 105/stem spacer 115 assembly shown inserted into a cup holder cavity 110. As can be seen in the FIG. 2 illustration, it is an advantage of the systems and methods that the stem spacer 115 substantially eliminates the risk of the wine glass 105 from tilting in the cup holder cavity. Notably, the stem spacer 115 "takes up" the space in the cup holder cavity around the stem 120.

Figure 3:
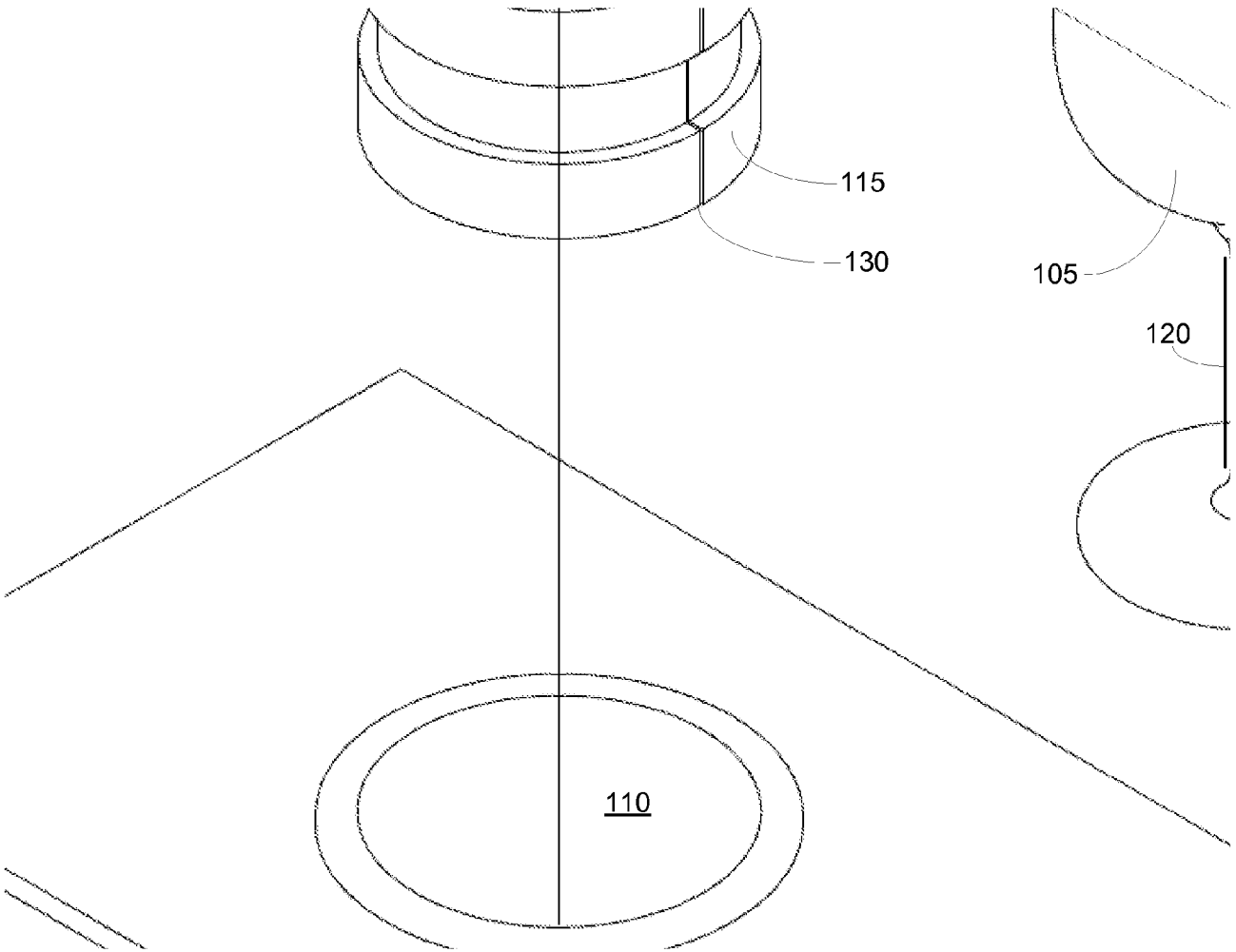
FIG. 3 is an exploded view of the wine glass and exemplary wine glass stem spacer of FIG. 2.

FIG. 3 is an exploded view of the wine glass 105 and exemplary wine glass stem spacer 115 of FIG. 2. It can be understood from the exploded view of FIG. 3 that a typical wine glass 105 having a stem may be inserted by its stem into a stem spacer 115 such that the wine glass 105 and stem spacer 115 combination can be placed into a cup holder 110. The stem 120 of the wine glass 105 may be received through substantially the center of the stem spacer 115 and then the assembly placed in the cup holder 110.

Figure 4:
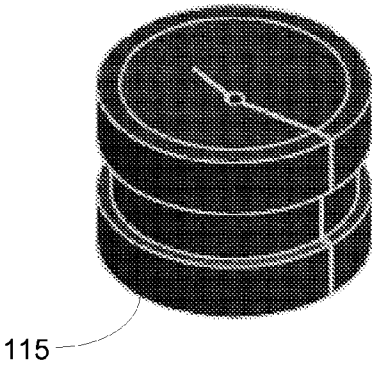
FIGS. 4A-4D illustrate an exemplary wine glass stem spacer according to one embodiment of the solution.
Figure 4:
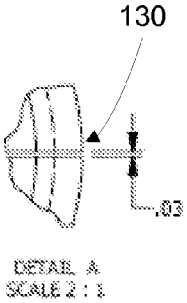
Figure 4:
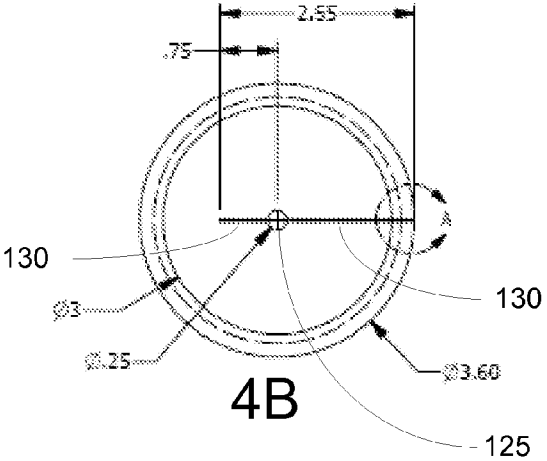
Figure 4:
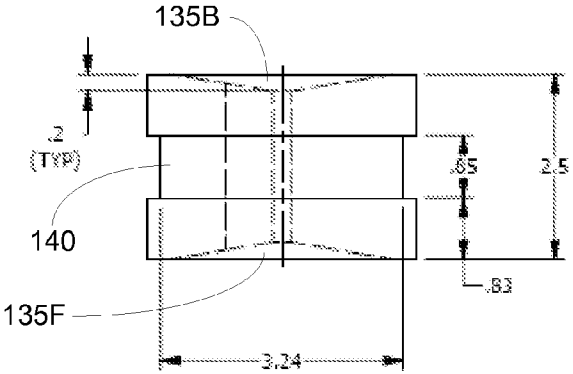

FIG. 4 illustrates an exemplary stem spacer 115 according to one embodiment of the invention. The dimensions included in the FIG. 4 illustration are offered for illustrative purposes only and do not imply or suggest that all embodiments of the invention will conform to such dimensions. Additionally, it is envisioned that embodiments of a stem spacer may include, or exclude, any of the features or aspects depicted in the FIG. 4 embodiment and, as such, it will be understood that a stem spacer is not limited to the particular embodiment shown and described relative to FIG. 4 (or any of the preceding Figures). An embodiment of a stem spacer according to this disclosure may be any device configured to receive a wine glass stem and provide stability to a wine glass when placed in a cup holder.

Referring to the FIG. 4 illustration, a three dimensional rendering 4D of an exemplary stem spacer 115 is depicted at the upper right. An elevation view 4A, a top view 4B and a close-up view 4C of an aspect of the exemplary embodiment 115 are also included in the illustration. As can be seen in FIG. 4, certain embodiments may include one or more contoured aspects 135B, 135F for communicating with the underside of a wine glass bowl (135B) or the topside of a wine glass foot (135F). Also, as previously described, some embodiments may include a stem insertion slit 130 that leads to (and sometimes beyond) a stem receiving cavity 125. As one of ordinary skill in the art will recognize, by extending the stem insertion slit 130 beyond the stem receiving cavity 125, i.e. greater than the radius of the stem spacer body, a hinge aspect may be provided such that the stem spacer 115 can be spread open for easy receipt of a wine glass stem 120. Notably, because certain embodiments of a stem spacer 115 may be constructed from resilient materials that feature shape memory qualities, the stem spacer may retract from a spread open state such that a received stem 120 is retained within the stem receiving cavity 125. It is further envisioned that certain embodiments may include other features such as, but not limited to, bosses suitable for display of advertising content, suction relieving features and/or ergonomic features such as groove 140, etc.

Again, although the exemplary embodiments depicted and described herein are generally of a cylindrical form, it is envisioned that certain other embodiments may take different shapes such as, but not limited to, a cone, an hour glass, a sphere, etc.

Various aspects, features and characteristics of the present invention have been described. Not all of the aspects, features or characteristics are required for each and every embodiment of the present invention. However, it will be appreciated that the various aspects, features, characteristics and combinations thereof may be considered novel in and of themselves.

What is claimed is:

1. A wine glass stem spacer for mounting to a wine glass stem, the wine glass stem spacer comprising:

a solid cylindrical body defining a circular upper surface, a circular lower surface and a curved outer surface;

a cylindrical stem receiving cavity defining a center axis of the solid cylindrical body, the center axis perpendicular to the circular upper surface and the circular lower surface; and a stem insertion slit extending from the lower surface to the upper surface and defining a plane extending from the curved outer surface to the cylindrical stem receiving cavity;

wherein the stem insertion slit is operable to be temporarily expanded from a default state to receive the wine glass stem into the cylindrical stem receiving cavity such that when the stem insertion slit is allowed to return to the default state the wine glass stem spacer is mounted to the wine glass stem by virtue of the wine glass stem being positioned into the cylindrical stem receiving cavity.

2. The wine glass stem spacer of claim 1, wherein the solid cylindrical body has a height of 2.5 inches.

3. The wine glass stem spacer of claim 1, wherein the solid cylindrical body is comprised of foam rubber.

4. The wine glass stem spacer of claim 1, wherein at least one of the circular upper surface and circular lower surface comprises a concave aspect for interfacing to the bowl or foot of a wine glass.

5. The wine glass stem spacer of claim 1, further comprising a vacuum prevention aspect along the curved outer surface, wherein the vacuum prevention aspect mitigates generation of a suction force when the wine glass stem spacer is mounted to a wine glass and inserted into a cup holder.

* * * * *